US010464714B2

(12) United States Patent
Canziani Hoffa

(10) Patent No.: US 10,464,714 B2
(45) Date of Patent: Nov. 5, 2019

(54) CLOSING ASSEMBLY FOR A CONTAINER, SUCH AS BOTTLES AND/OR FLASKS, REMOVABLE CARTRIDGES, CLOSING DEVICE, AND METHOD

(71) Applicant: Mauro Andres Canziani Hoffa, Vitacura (CL)

(72) Inventor: Mauro Andres Canziani Hoffa, Vitacura (CL)

( * ) Notice: Subject to any disclaimer, the term of this patent is extended or adjusted under 35 U.S.C. 154(b) by 0 days.

(21) Appl. No.: 15/540,533

(22) PCT Filed: Dec. 29, 2014

(86) PCT No.: PCT/CL2014/000090

§ 371 (c)(1),
(2) Date: Mar. 2, 2018

(87) PCT Pub. No.: WO2016/106457

PCT Pub. Date: Jul. 7, 2016

(65) Prior Publication Data

US 2018/0208363 A1 Jul. 26, 2018

(51) Int. Cl.

| | |
|---|---|
| ***B65D 25/08*** | (2006.01) |
| ***B65D 5/48*** | (2006.01) |
| ***B65D 47/38*** | (2006.01) |
| ***B65D 51/28*** | (2006.01) |

(52) U.S. Cl.

CPC ..... *B65D 25/08* (2013.01); *B65D 5/48* (2013.01); *B65D 47/38* (2013.01); *B65D 51/2821* (2013.01); *B65D 51/2835* (2013.01)

(58) Field of Classification Search

CPC . B65D 25/08; B65D 5/44; B65D 5/48; B65D 47/00; B65D 47/38; B65D 51/28; B65D 51/2821; B65D 51/2835; B65D 47/243

See application file for complete search history.

(56) References Cited

U.S. PATENT DOCUMENTS

| | | | | |
|---|---|---|---|---|
| 4,808,006 A | | 2/1989 | Kaufeler | |
| 6,003,728 A | * | 12/1999 | Elliott | B65D 47/0804 206/219 |
| 6,230,884 B1 | * | 5/2001 | Coory | B65D 51/2821 206/222 |

(Continued)

FOREIGN PATENT DOCUMENTS

| | | |
|---|---|---|
| ES | 2398509 T3 | 3/2013 |
| WO | 2010025392 A2 | 4/2010 |

OTHER PUBLICATIONS

International Search Report and Written opinion for PCT App. No. PCT/CL2014/000090 dated Sep. 22, 2015, 11 pgs.

*Primary Examiner* — Nicholas J. Weiss

(74) *Attorney, Agent, or Firm* — Michael A. Bondi; Moss & Barnett

(57) ABSTRACT

The invention relates to a closing assembly for containers, such as bottles and/or jars, which allows a hermetically isolated additive to be dispensed into the inside of said container, via a cartridge, characterised in that the assembly comprises a closing device having a main body (3) with joining means that allow detachable connection to a removable cartridge (4) storing the additive to be released, where said removable cartridge (4) houses a piercing projection (5) that can be actuated by direct contact with an actuator (2) connected to said main body (3).

24 Claims, 9 Drawing Sheets

(56) References Cited

U.S. PATENT DOCUMENTS

Figure 1:
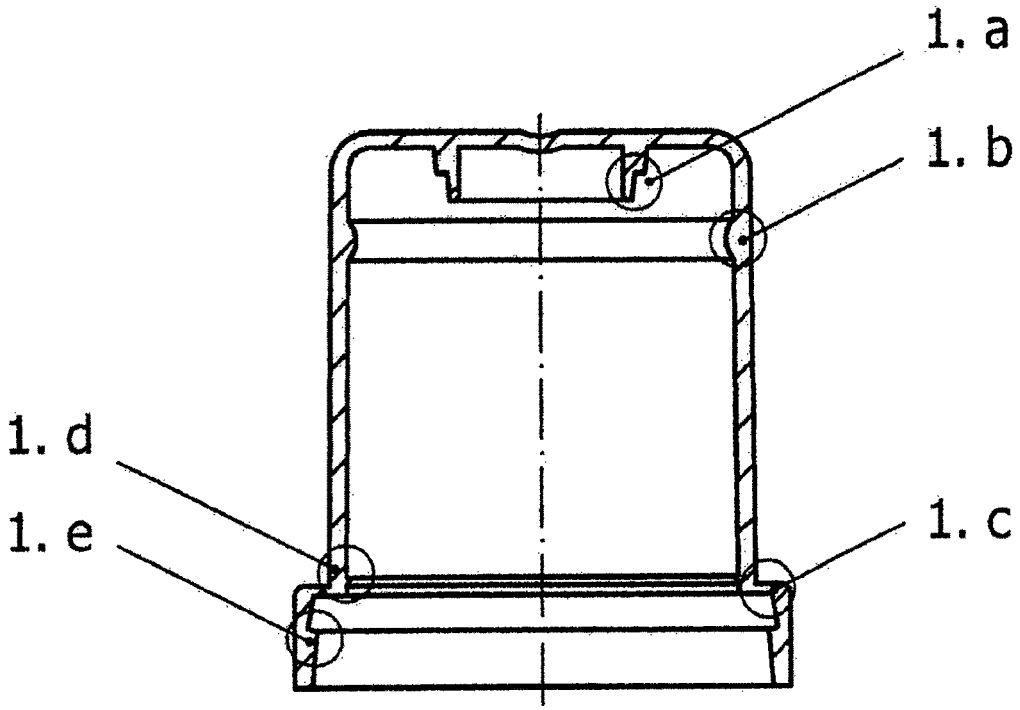

| | | | | |
|---|---|---|---|---|
| 7,703,642 | B2 * | 4/2010 | Scott | B65D 47/127 215/254 |
| 8,356,711 | B2 * | 1/2013 | Canziani Hoffa | B65D 47/243 206/222 |
| 8,590,753 | B2 * | 11/2013 | Marina | A47J 31/407 222/325 |
| 8,960,424 | B1 * | 2/2015 | Anderson | B65D 51/2835 206/219 |
| 9,242,772 | B1 * | 1/2016 | Anderson | B65D 47/243 |
| 2006/0280841 | A1 * | 12/2006 | Cai | A47J 31/14 426/77 |
| 2006/0289316 | A1 * | 12/2006 | Henry | B65D 81/3211 206/219 |
| 2008/0116221 | A1 * | 5/2008 | Roth | B65D 47/243 222/129 |
| 2009/0057262 | A1 * | 3/2009 | Cho | B05B 11/0083 215/252 |
| 2010/0059394 | A1 * | 3/2010 | Fontana | B65D 51/2814 206/222 |

* cited by examiner

CLOSING ASSEMBLY FOR A CONTAINER, SUCH AS BOTTLES AND/OR FLASKS, REMOVABLE CARTRIDGES, CLOSING DEVICE, AND METHOD

The present invention relates to a closure device for bottles and/or flasks, which in turn is a dispenser of active formulas housed in an interchangeable hermetic cartridge anchored therein, having means specially designed to be able to evacuate them towards the Liquid or contents of the bottle at the time the mixing is required. The invention also relates to the method of manufacturing the closure device.

This closure device is provided with an interchangeable tubular cartridge designed hermetically for containing active formulas therein, and which in turn contain a central pushing-cutting carriage movable therein, which is driven mechanically by an external handle for cutting The seals of said tubular cartridge and push the active formulas into a bottle or bottle containing liquid therein, thus allowing the mixing of the formula with the contents of the bottle at the instant of being required.

This type of dispenser closure devices are beginning to be used in the food field for the incorporation of elements such as vitamins or minerals, called the fortification process, in which its components need to be stored separately to the contents of the container, in order to Protect the active principles of moisture, oxygen and light, thus increasing its useful life and improving its effectiveness. In addition the ability to interchange the cartridge increases the life of the device because it allows adding countless new cartridges with active principle by maintaining and reusing the Central Body of the device.

Similarly, these closure devices allowing the addition of substances are used in the medical and/or pharmacological field, allowing the mixing of active formulas, such as probiotics, extemporaneously, thus avoiding the rapid degradation of the final compound; In both cases, it is sought to release a particular hermetically contained and protected additive, brief moments before using and/or consuming the contents of the package allowing mixing and subsequently releasing the already mixed product.

On the other hand, separating the central body from the interchangeable sealed cartridge allows reusing the base body countless times, and the cartridge can be marketed separately, facilitating its transport and distribution, saving space in its distribution and logistics.

On the other hand, the ability to change cartridges makes quality control easier in the mix of extemporaneous products (generally this type of active ingredients are highly reactive and degradable), this means that if any part of the active ingredient has a Problem, the cartridges can be quickly removed from the device without having to destroy the device in order to access them.

On the other hand, another important feature to mention is that unlike today's solutions in dispensing devices, having an interchangeable cartridge implies being able to dispense a number of different volumes using the same Central Body of the device, since the interchangeable cartridge may have different Dimensions and therefore contain different volumes of formulation to dispense, which gives a flexibility until now not known.

DESCRIPTION OF THE STATE OF THE ART

At present, it is possible to find different alternatives of devices that allow to release solid or liquid additives towards the interior of the container to which they are attached.

There are known in the state of the art closures having a cavity for the storage of an additive which is released into the container by vertically pressing a part of the device, thereby enabling the perforation and/or pressing of a seal which closes said cavity.

It is seen in the applications Nos. 2007/0023381 and WO2008/061766, devices having a non-interchangeable closed volume or compartment therein, with an upper wall formed by a flexible membrane, and a base formed by a collapsible layer, which Is ruptured by exerting pressure on the membrane thereby allowing the additive to be released into the container. In these cases, the additive is limited to some formats in liquid or solid state, which allow to directly transmit the mechanical pressure exerted by the user to break the seal.

One of the limitations that can be observed in the mentioned references is that once the additive has been released into the package, it is necessary to remove the closure piece completely to consume or use such contents. Another unsolved point is the process of breaking the lower seal which, under pressure, does not allow to control the cutting process whereby it has been shown that portions of the sealing membrane can be released into the liquid of the bottle. One of the qualities of the present invention is that it is not required to remove the closure piece to use the product of the package or to consume the already mixed liquid.

On the other hand, thanks to the configuration of a central pushing-cutting inner carriage, the additive is not limited to a solid or liquid form that exerts pressure and breaks the seal, but allows the release of liquid, powder or liquid substances. Solid indistinctly with full control of the cutting process, preventing seal waste from falling into the bottle.

In the case of the application WO 02/074647, there is shown a push-and-pull type closure device, with a sliding part surrounded by a ring which in its lowered position allows punching and pressing a membrane corresponding to a seal Commonly applied by induction in bottles or containers, to later release the liquid contained in the container or bottle to the outside.

In the case described above, the main difference with the closure part of this application is that the prior art device is designed to be placed on a bottle which in its upper part already has a closure, an induction seal, And does not allow nor is it designed to dispense formulas or active components into the bottle as is the case of the invention presented in this application. In the latter, there is provided a closure system which enables the additive to be kept sealed without the need to seal the bottle. The present application is derived from the international patent application PCT/CL2009/000024. This previously mentioned application has an additive dispensing seal for containers and/or bottles. The differences of the present application with this document of the state of the art lie in the ability of the device to be able to exchange at will the space where the active ingredient of extemporaneous mixing is contained while maintaining the tightness of the same system.

For the case described above and the present invention, the technical problems solved are different since for document PCT/CL2009/000024, it is sought to maintain a hermetically active principle by mixing it extemporaneously in a solution without requiring removal of the device in order to consume the (For the consumption of the active principle), while for the present invention it is sought to be able to re-use the central body of the device innumerable times and thus be able to re-create a hermetic dispensing device through the placement of a hermetic cartridge Disposable, it can thus mix extemporaneously repetitively the same or different types of active principles in a solution and be able to consume the different mixes as many times as the consumer wants. All this only through changing the hermetic interchangeable cartridge.

On the other hand, the quality control of the active ingredient in the extemporaneous mixing cartridges in the finished product (before use) is safer because of the capacity of replacement of the cartridges if the active principle had a failure, which is not possible In the system presented in PCT/CL2009/000024 where the space to store the active principle is integral to the system and not removable. Another object of the present invention is to be able to change the internal capacity of the cartridge and thus the final dose to be applied, using the same central body of the device (because large or small cartridges can be constructed depending on the amount of active ingredient being to apply).

Commercially and operatively the products can be displayed and offered separately, on the one hand the central body of the device with the bottles and/or bottles and on the other the cartridges. This separation makes the filling of the extemporaneous active principle can be realized in terms closer to its consumption as opposed to the body of the device as these can be stocked as it does not suffer degradation.

The use by the end consumer of this new type of dispensing system with interchangeable cartridge is double, because on the one hand can be used as a sports cap type sport cap in order to facilitate the consumption of the mixed drink without removing the lid and the other side the lid is transformed into a dispensing device of hermetically isolated formulas when adding the cartridge to the central body.

Thus, the present invention seeks to provide a solution to the problems of the art associated with the reuse of the central body of a sealing dispensing cap, the dispensing of different types of volume of formulas with the same central body reusable from a dispensing cap. The decrease of the plastic use of a dispensing system of formulas as well as the minimization of the transportation space and storage of dispensing closure systems. These technical problems previously mentioned have not been solved in the state of the art on this type of devices.

DESCRIPTION OF THE INVENTION AND THE DRAWINGS

The object of the present invention is to propose a closure device for bottles and/or bottles, which in turn is an active form dispenser housed in an interchangeable hermetic cartridge anchored therein, wherein said device has a configuration allowing The addition or release by mechanical means of an additive or active ingredient into the container to which it is attached, this substance being in a solid state (in the form of a tablet or powder, granular or other format), or fluid, gel or the like).

In this case, the additive is kept hermetically isolated from the outside, both during storage and during its release.

The present device has a structure consisting of five parts: a cover, an actuator, the system base body, a removable cartridge and a movable push-cutting carriage. These parts are coupled together, forming a single unit which is the closing device.

The description of the figures of this presentation allow a better understanding of the device to be protected and its components:

FIG. 1/9 shows the cover (1), which corresponds to a cap, which consists of a body Preferably circular, elongated, closed at the top, and open at its bottom, which comprises: a grooved safety belt (1.*e*) attached at its lower open edge;

a cover shoulder (1.*b*) formed in the contour of the inner surface of the elongated body, in its upper portion;

and a tongue-shaped seal member (1.*a*) disposed circularly at the top of the cover, which extends inwardly of said cover;

a housing (1.*c*) for fixing the grooved safety belt (Le) to the base body (3); Y a rod (1.*d*) for securing the cover (1) to the base body (3) once it is opened.

Figure 2:
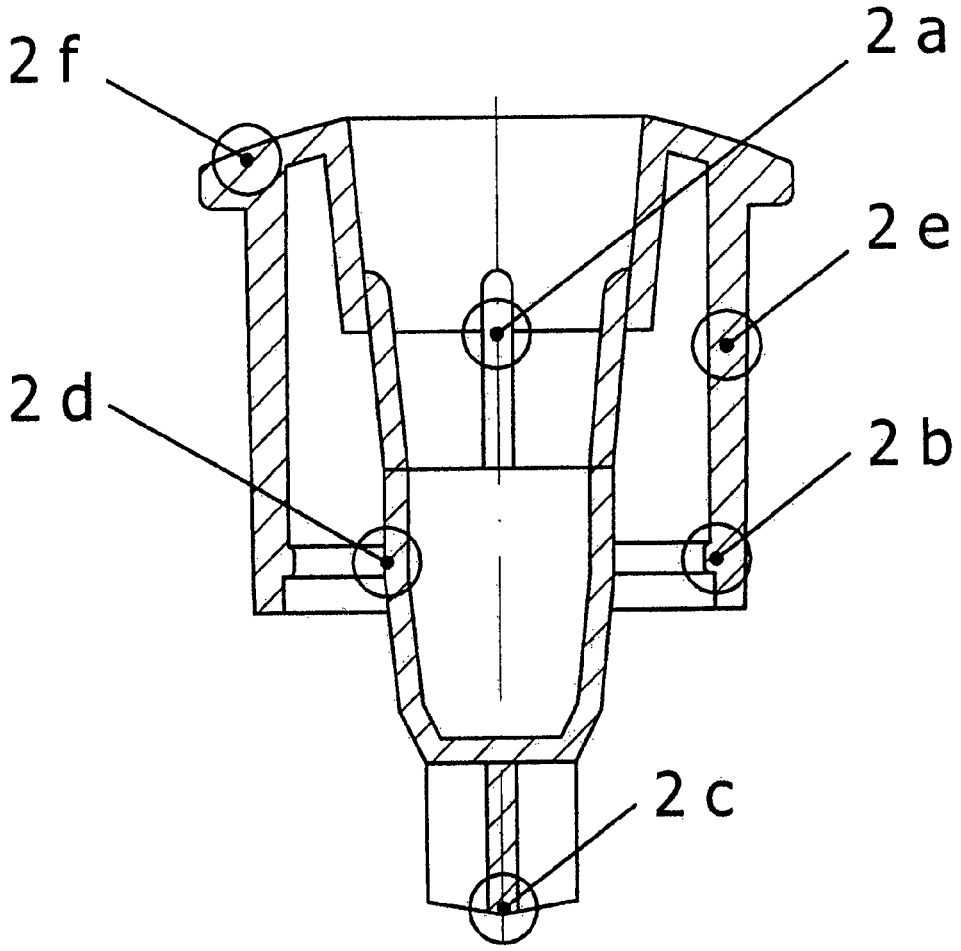

FIG. 2/9 shows the actuator 2 of the device, corresponding to a sliding part with a vertical through central perforation, and is formed by: a circular outer wall (2.*e*) having a shoulder (2.0 at the periphery of its upper edge.

an inner surface (2.*d*), surrounding the central perforation, having a conical shape, and which takes a cylindrical shape in its lower portion and ends in a cross-shaped cutting and pushing element (2.*c*);

An actuator ring (2.*b*) on the outer wall and disposed circularly towards the free space between the outer wall and the inner conical surface; Y ribs (2.*a*) whose function is to allow the flow of liquid to the outside of the closing device when in use.

Figure 3:
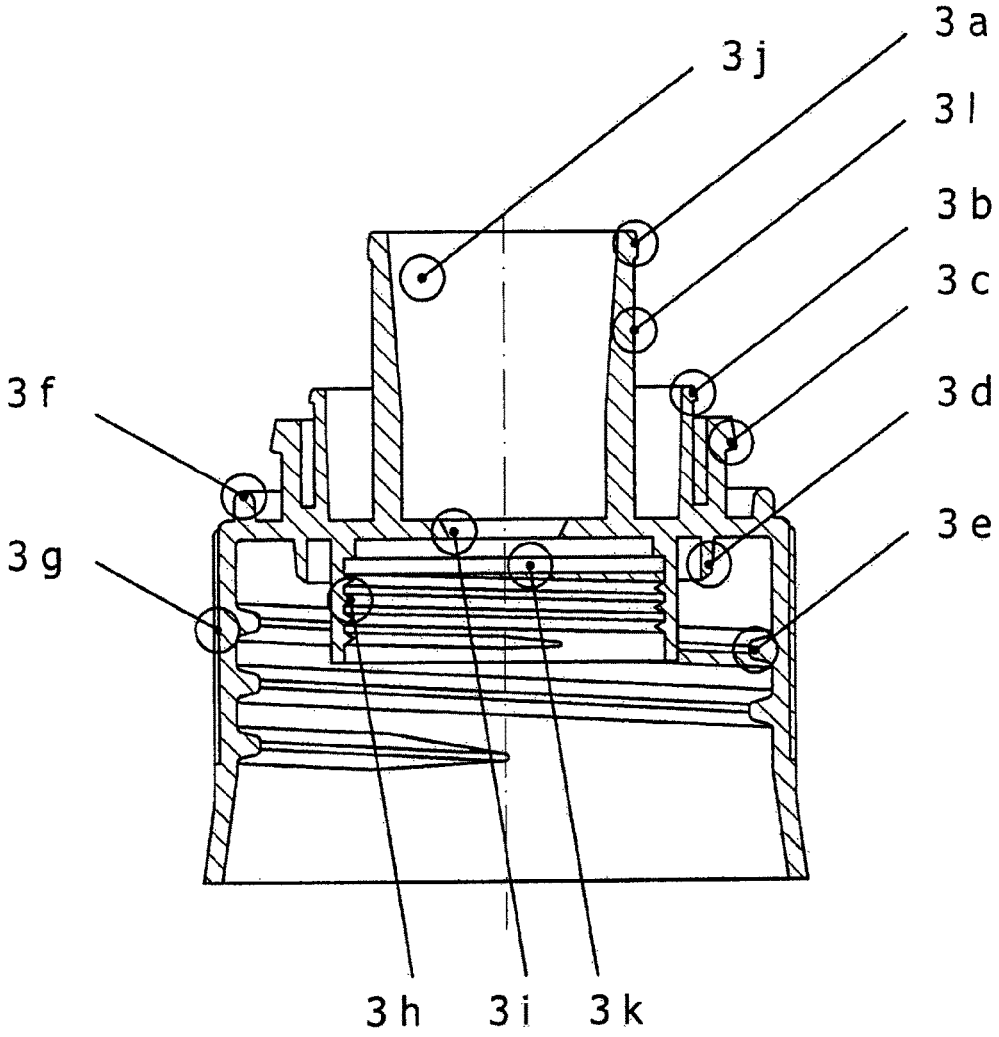

FIG. 3/9 shows the base body (3) of the device, which is composed of:

A nozzle (3.*j*) is missing in the figure with a central bore (3.*i*) conical on its lower surface, and having a peripheral nozzle (3.*a*) projection at the upper end of this nozzle;

A tongue-shaped ring (3.*b*) connected at its inner margin to the nozzle and at its outer margin to an upper skirt (3.*c*);

A lower inner skirt (3.*e*) which engages with the outer yarn of the container to which the device is attached;

a central compartment or tubular space (3.*k*) is missing the number in the figure, inside the skirt, connected to the nozzle (3.*j*), the number in the figure is missing through the conical perforation (3. *i*), and which is open at its bottom, which is surrounded by a wall (3.*l*), is missing the number in the figure, which has a yarn inside (3.*h*) in its central portion for connecting or tying the cartridge removable.

Figure 4:
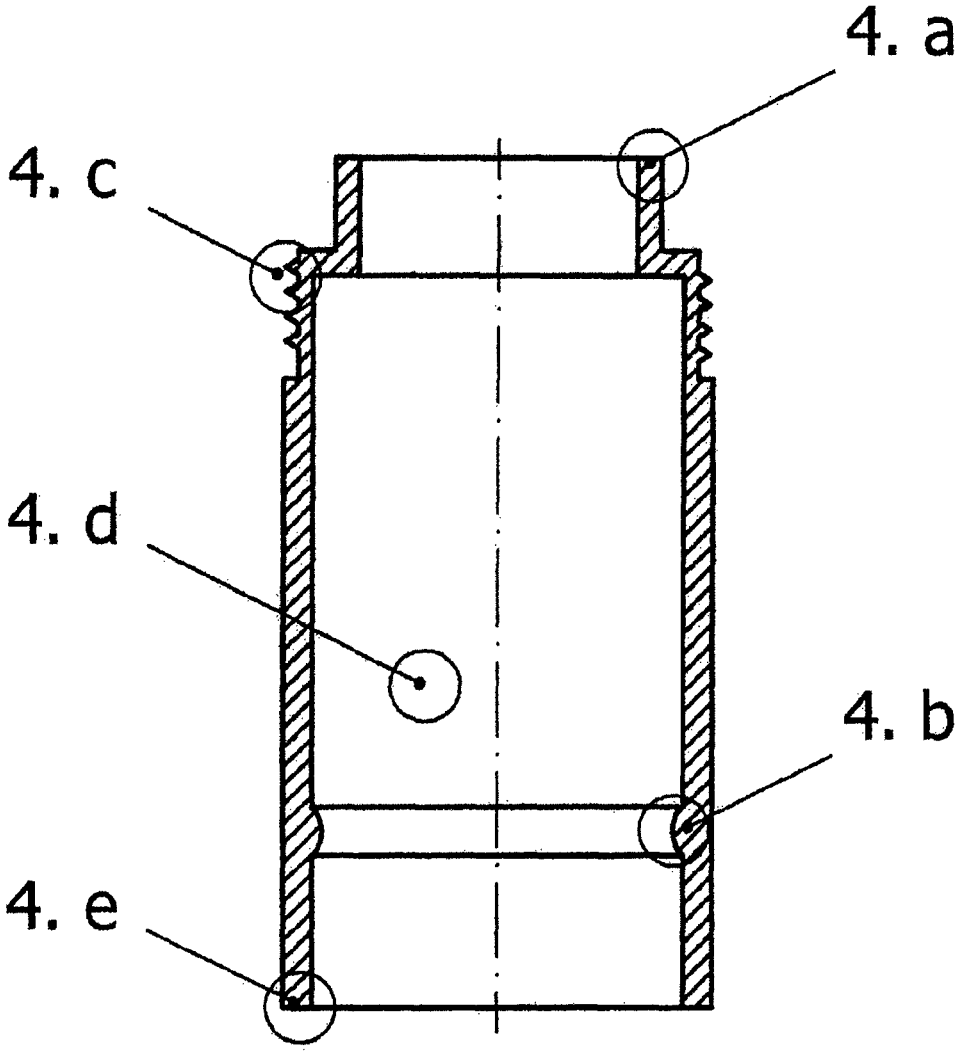

FIG. 4/9 shows the removable cartridge (4) of the device, which corresponds to an open cylinder at its two ends protruding twice as long as the part of the body with thread attached to the bottle, which is Composed of: membranes (4.*e*, 4.*a*) sealing the central compartment (4.*d*), in its lower and upper parts;

(4.*b*) internal protrusion located in the central area of the removable cartridge; and External thread at the top (4.*c*) to connect or tie the cartridge to the base body (3) through its inner thread (3.*h*). Preferably, the removable cartridge (4) may further comprise at least one cap (not shown) on at least one end of the cartridge, wherein said cap is connected to said end of the cartridge by means of a threaded connection.

In an alternative embodiment, the removable carton 4 further comprises an outer protrusion surrounding the entire outer perimeter of the cartridge near its lower end and which is useful for properly holding the cartridge in the filling step of the additive, especially when it is liquid.

Figure 5:
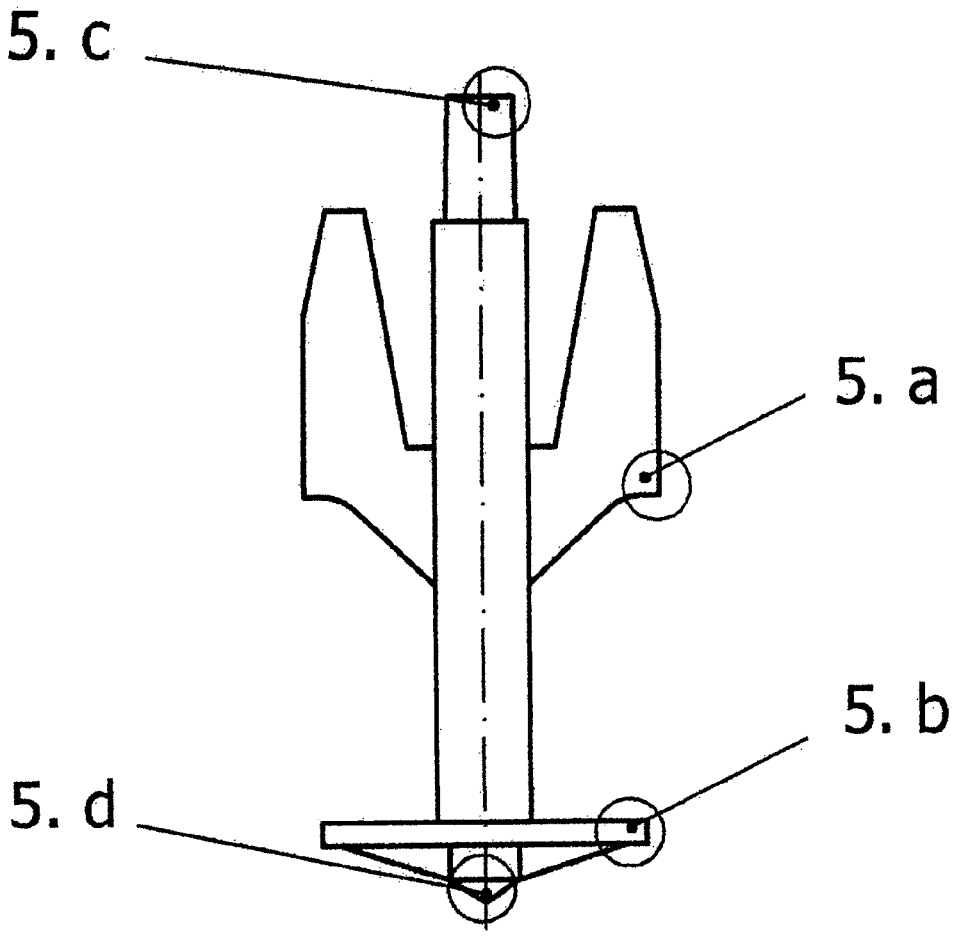

FIG. 5/9 shows the replaceable push-cut projectile (5), corresponding to a movable inner arrow, positioned inside the removable cartridge (4) where the additive to be released is stored, and is formed by:

cutter (5.*b*) whose function is to cut or perforate the lower membrane sealing the removable cartridge (4)

guide vanes (5.*a*) for keeping the cutter centered (5.*b*)

stop (5.*c*) acting as a point of contact with the actuator (2) to push the cutter (5.*b*).

tip (5.*d*) to start cutting or opening the seal membrane.

Figure 6:
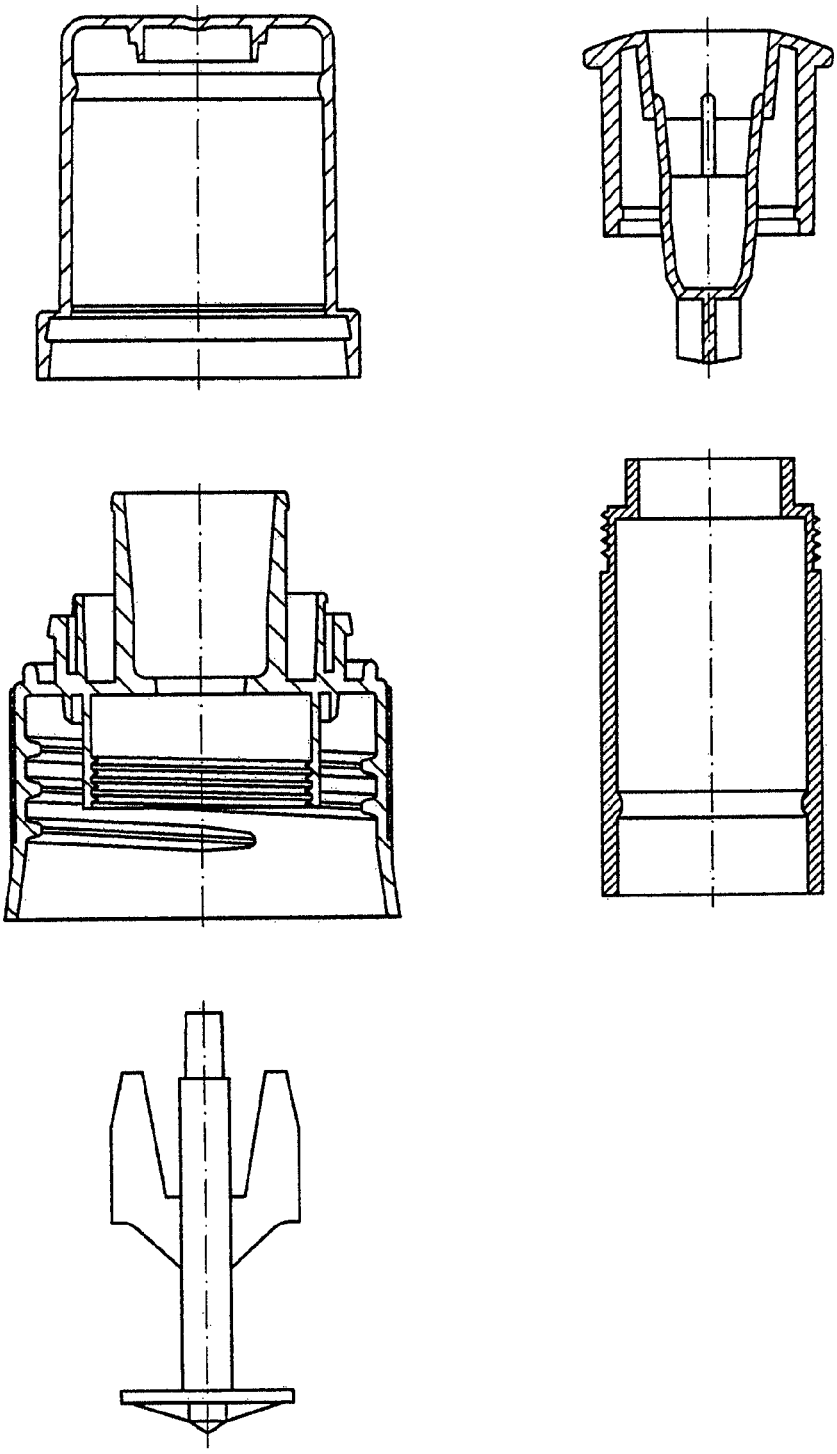

FIG. 6/9 shows all the component parts of the present closure device, in an exploded view and in the configuration in which they are assembled for use.

Figure 7:
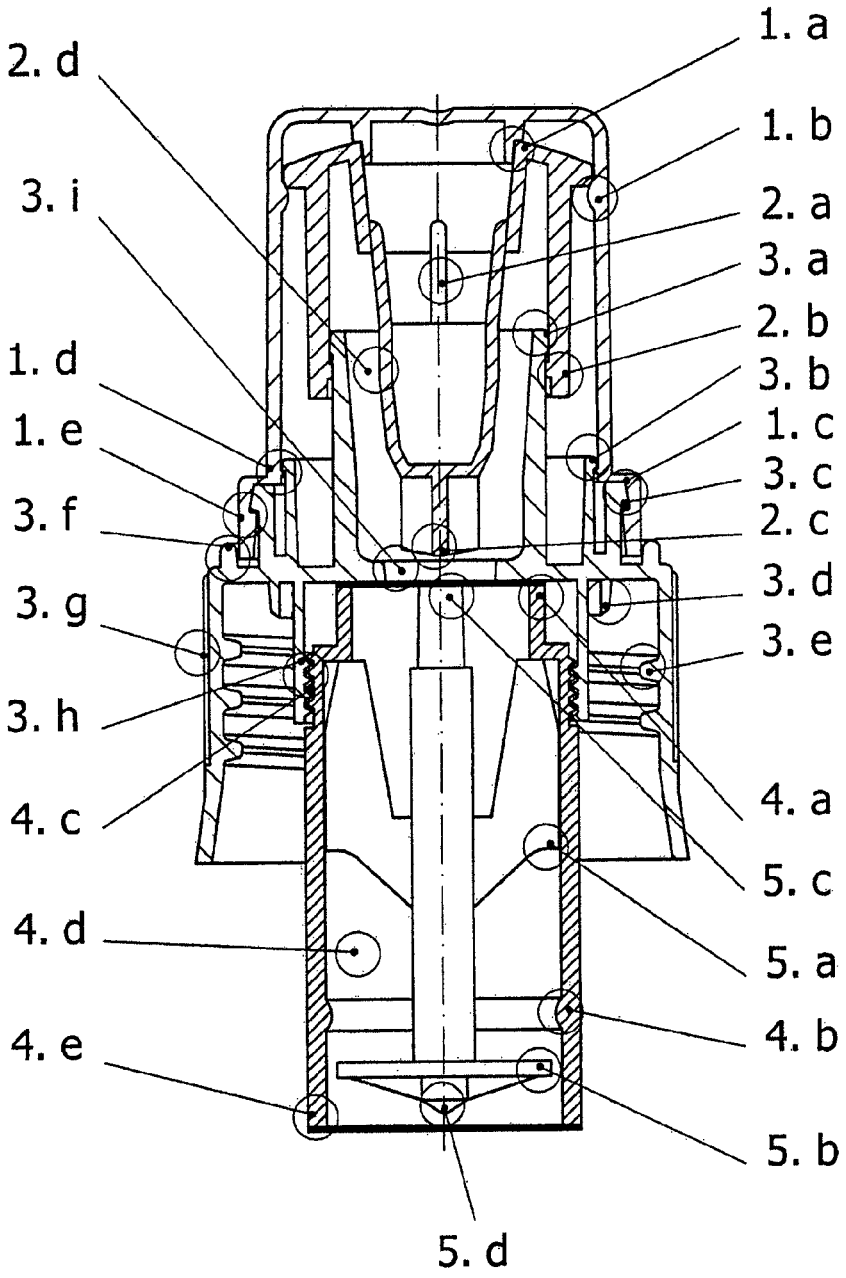

In FIG. 7/9, the same device is observed but assembled, in its closed position, with its four component parts, as it is attached to the package; This view shows the removable cartridge 4 which is hermetically sealed by the membranes 4*e*, 4*a*, which in turn contain the additive to be released and the replaceable push-cut projectile 5, Into the central compartment of the base body (3) of the device.

Figure 8:
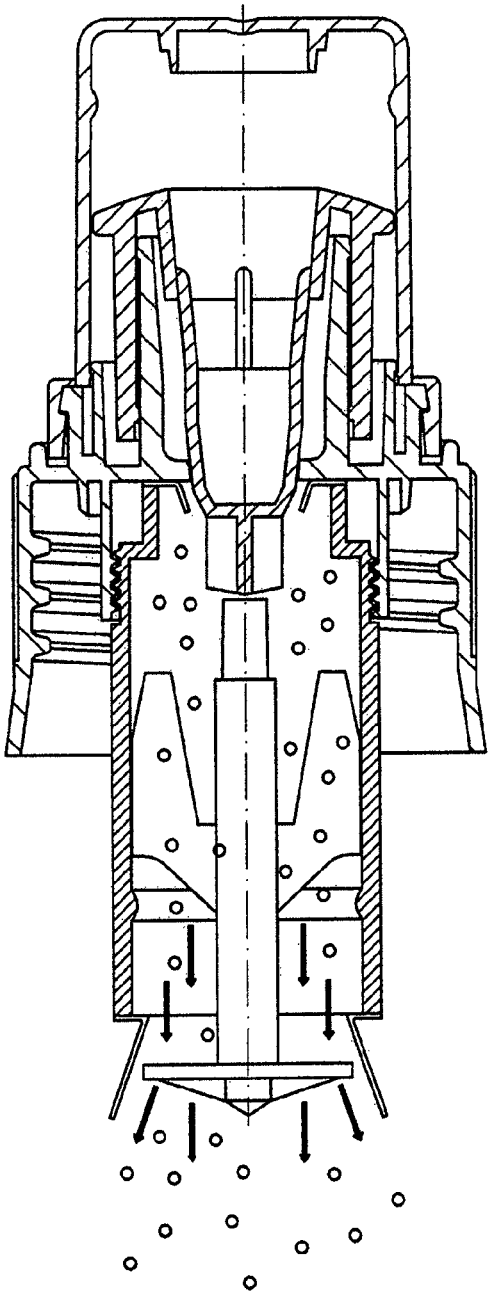

In FIG. 8/9, the device is shown in the discharge position, and the actuator (2) has been lowered by pushing the projectile, which has partially cut off the lower seal and released the additive into the container.

Figure 9:
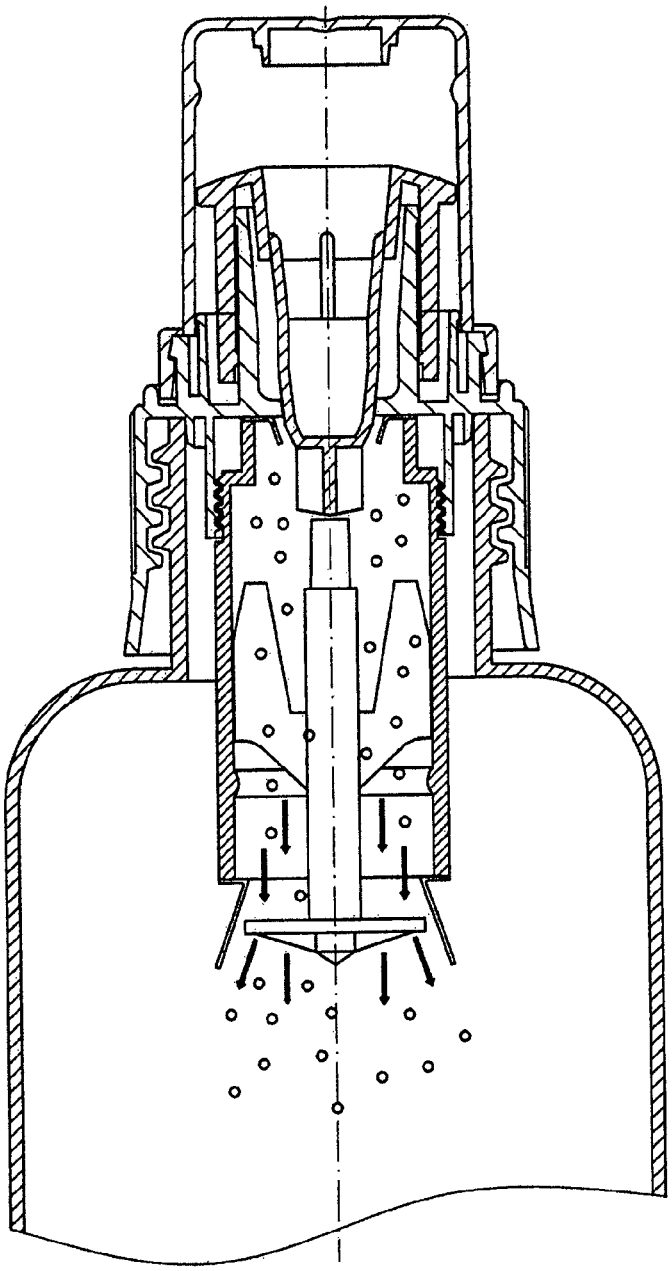

FIG. 9/9 shows the closure device in the open position, i.e., once the additive has been dispensed into the container, and the actuator (2) is raised again, thereby communicating the exterior with the inside of the container. In this position, the mixed contents of the inside of the package can be used.

The closure device of the invention is attached to a container of the bottle type or the like by the hooking of the floss yarn (3.*e*) to the outer yarn presented by the package.

In its closed position, i.e. when the device has not yet been manipulated, the cover (1) is attached to the ring (3.*c*) of the base body, in the area of its safety belt (1.*c*).

In this position, the actuator 2 abuts its outer wall 2.*e* over the nozzle 3*j* of the base body, generating a contact between its peripheral shoulder 2.*f* and the cover shoulder 1.*b*) of the cover presenting the nozzle of the base body. The contact between said parts establishes closed volumes between the cap (1), the base body (3) and the actuator (2), which form a barrier that prevents the passage of air or contaminants to the sector where the Stored additive. The central perforation of the actuator (2), in turn, is sealed to the air or moisture passage into it, since the seal tab (1.*a*) of the cover stays in contact with the entire contour of the surface inside the actuator, forming an additional insulation volume.

In this same position of the closed device, the removable cartridge 4 is disposed and anchored by external thread at the top (4.*c*) inside the central compartment of the base body and sealed by the component membranes of the upper removable cartridge And lower (4.*a*, 4.*e*).

At the moment of wanting to dispense the additive in the bottle, the cover (1) must be removed, thereby releasing its safety belt (1.*e*), to which it will be fixed to the base body (3) of the device.

Subsequently, the actuator 2 is pushed by the user into the container, whereby its lower cross-shaped portion (2.*c*) breaks the upper seal membrane (4.*a*) thereby introducing the removable cartridge (4) where it in turn pushes replaceable thrust-cut projectile (5).

When the central projectile 5 is pushed and moved downwards, its lower edge in the form of a pointed plunger 5.*d* partially and centrally cuts the lower seal membrane 4.*e*, thereby allowing the release of the additive Into the container; The protruding shoulder of the projectile (5.*a*) is stopped in its advance by the internal projection (4.*b*) of the central compartment, where it is engaged, which prevents the seal membrane (4.*e*) from being completely cut off and Drop into the package together with the additive. The mixture of the additive in the liquid initially contained in the bottle can then be carried out. In turn, the conical lower part of the actuator perfectly seals the space through which it penetrates the tubular space, whereby it is allowed to stir and mix the additive next to the liquid of the container without allowing leaks or liquid outflows.

To use the mixture or final contents of the package, the actuator must be pulled into its initial position whereby the fluid will pass through the perforations of the projectile in its upper closure towards the central perforation of the actuator. In this way, it is evident that it is not necessary to remove the closure device in order to be able to drink or use the mixture that was generated inside the package.

Once the removable cartridge 4 is used, the device is opened by separating the base body 3 from the bottle or container by unscrewing it, then the removable cartridge 4 is unscrewed from the inner wire 3.*h*) and replaced with a new cartridge and then proceed to reconnect the bottle with the base body (3).

The material of the device is preferably a rigid plastic material, but not limited solely to the use of plastic materials in its manufacture.

Another aspect of the present invention relates to the productive process of the closure device, which consists of a series of steps associated with the manufacture of parts and pieces, assembly and filling of the product so that it can be finally used Or commercialized. The main steps of the production process of the closure device are described below, which can be carried out by manual or automated manufacture, on a production line or by an intermittent manufacturing process.

First of all, the manufacturing process consists of the production of each of the parts and pieces, which is preferably performed by some of the plastic injection processes known in the state of the art.

Once each of the parts is counted, the assembly step is carried out, which consists in properly connecting each of the elements forming the closure device, namely the base body, the actuator and the removable cartridge So that they can provide the functionality for which said closure device was designed.

After each of the elements that make up the closure device are properly assembled, it is appropriate to position the sealed membranes in the removable cartridge lids for later filling and sealing. Said membranes may be formed from various materials distributed in layers, the most usual among many alternatives being a thin film of paper pulp material with glue which is disposed inside the lid. The next layer is wax and is used to adhere an aluminum foil to the paper. Finally, the last layer is a polymer film laminated onto the metal. First, the removable cartridge is sealed to the lower membrane. The cartridge is passed under an induction coil, which emits an oscillating electromagnetic field. When the cartridge passes under the induction loop the aluminum foil conducting the electricity begins to heat up. The heat melts the wax, which is absorbed into the pulp of the paper and releases the metal foil from the lid. The polymer film is also heated and flows towards the rim of the container opening. Upon cooling, the polymer forms a bond with the container and thereby establishes an airtight seal. This process, which occurs within a few seconds, does not affect the container or its contents. Once the first membrane is properly sealed to the lower end of the cartridge, the push-cut projectile is incorporated into the removable cartridge and the filling step is performed. This last step is to inject the corresponding fluid or powder into the removable cartridge through its upper end, which can generally be made by pressure filling machines, usually used in the packaging industry.

With the removable cartridge already filled, the latter is definitely sealed by arranging a membrane at the upper end of the cartridge according to the same process as to provide the above described lower membrane. In this way it is possible to contain the product inside the removable cartridge in a hermetic and secure manner, ready for use or marketing independently or as part of the closure device.

For the latter case, the production process is concluded by assembling the removable cartridge to the base body of the device by means of the connection of the connecting means of the base body, to the attachment means of the removable cartridge. Therefore, the production process can be performed independently for both the closure device and the removable cartridge, optionally assembling the two parts in an end stage of the process.

The invention claimed is:

1. A closure assembly for a container, wherein the closure assembly allows dispensing a hermetically sealed additive into an interior of said container, wherein the closure assembly comprises:

a base body (3) having first connecting means for attachment to the container, an actuator (2) comprising a cut-push element at a lower end thereof, wherein the actuator is slidably connected to said base body (3), wherein the actuator is movable between a closed position and a release position, a removable cartridge (4) where the additive to be released is stored, said removable cartridge (4) comprising:

a central compartment (4.*d*) within which the additive to be released is stored;

a push-cut projectile (5) comprising a pointed plunger at a lower edge thereof; and sealing membranes at a lower portion (4.*e*) and at an upper portion (4.*a*) that seal hermetically the central compartment (4.*d*), wherein the base body (3) and the cartridge (4) have second connecting means that enable their mutual detachable coupling, and wherein when the cartridge (4) is connected to the base body (3), wherein movement of the actuator (2) to the release position causes the cut-push element (2.*c*) to break the upper sealing membrane (4.*a*) and enter the removable cartridge (4) where the cut-push element (2.*c*) pushes the push-cut projectile (5) so that the pointed plunger (5.*d*) partially and centrally cuts the lower sealing membrane (4.*e*) allowing release of the additive into the container.

2. A removable cartridge (4) for an additive that is to be released into a container, wherein the removable cartridge enables hermetic isolation of the additive prior to dispensing into the container by way of a closure assembly, wherein the cartridge is shaped as a cylinder and is open at an upper portion and a lower portion thereof and wherein the removable cartridge comprises a central compartment (4.*d*) inside which the additive is stored;

a push-cut projectile (5) that is positioned in the central compartment, wherein the push-cut projectile comprises:

guide vanes (5.*a*) for keeping the cutter centered in the central compartment;

a stop (5.*c*);

a cutter (5.*b*);

a tip (5.*d*) to start cutting or opening the lower sealing membrane (4.*e*);

sealing membranes at the lower portion (4.*e*) and the upper portion (4.*a*) that hermetically seal the central compartment (4.*d*);

connecting means allowing removable connection of the removable cartridge to the closure assembly; and an internal projection (4.*b*) in a central portion thereof.

3. The closure assembly according to claim 1, wherein the connecting means comprises an external thread (4.*c*) located in the upper portion of the cartridge.

4. The closure assembly according to claim 1, wherein the push-cut projectile (5) comprises a movable inner arrow that is positioned inside the cartridge, wherein the push-cut projectile further comprises guide vanes (5.*a*) and a stop (5.*c*) and wherein the pointed plunger comprises a cutter (5.*b*) and a tip (5.*d*) to initiate the cutting of the lower sealing membrane.

5. The removable cartridge (4) according to claim 2, wherein the upper and lower sealing membranes comprise aluminum foils coated with an epoxy material and wherein the upper and lower sealing membranes are sealed on surfaces of the removable cartridge under pressure and heat.

6. The removable cartridge (4) according to claim 2 or 5, wherein the upper sealing membrane is covered by a first removable cap that is attached to at least one of the ends of the removable cartridge and wherein the lower sealing membrane is covered by a second removable cap that is attached to at least one of the ends of the removable cartridge.

7. The removable cartridge (4) according to claim 6, wherein the first and second removable caps are attached to the removable cartridge by a threaded connection.

8. The removable cartridge (4) according to claim 2, wherein the removable cartridge further comprises an internal shoulder (4.*b*) in a central portion of the removable cartridge (4).

9. The removable cartridge (4) according to claim 2, wherein the removable cartridge further comprises an outer protrusion proximate a lower end of the removable cartridge (4).

10. The closure assembly according to claim 1, wherein the base body (3) comprises:

a nozzle (3.*j*);

the first connection means for engaging the container; and a central compartment (3.*k*).

11. The closure assembly according to claim 10, wherein the nozzle (3.*j*) comprises a peripheral nozzle (3.*a*) at an upper end thereof and a central bore (3.*i*) at a lower end thereof.

12. The closure assembly according to claim 10 or 11, wherein the first connecting means comprises an internally threaded lower skirt (3.*e*) that engages an outer thread on the container to which the base body is attached.

13. The closure assembly according to claim 10, wherein the central compartment (3.*k*) comprises a wall (3.1) located inside the lower skirt (3.*e*) and which is in communication with the central bore (3.*i*) of the nozzle (3.*j*).

14. The closure assembly according to claim 10, wherein the central compartment (3.*k*) comprises the second connecting means that enables engagement of the base body (3) to the removable cartridge (4).

15. The closure assembly according to claim 14, wherein the second connecting means comprises an inner thread.

16. The closure assembly according to claim 10, wherein the base body (3) further comprises a tongue shaped ring (3.*b*) connected on an inner margin thereof to the nozzle and on an outer margin thereof to an upper skirt (3.*c*).

17. The closure assembly according to any one of claim 10, 11, 13, 14 or 15, wherein the actuator (2) comprises:

a central vertical through-hole;

an outer wall (2.*e*);

an inner element (2.*d*) surrounding the central vertical through-hole; and ribs (2.*a*) that allow the liquid to flow out of the closure assembly.

18. The closure assembly according to claim 17, wherein the inner element (2.*d*) has a conical shape at an upper portion thereof and a cylindrical shape at a lower portion thereof.

19. The closure assembly according to claim 17, wherein the outer wall (2.*e*) is circular and has a shoulder (2.*f*) at a periphery of an upper edge thereof.

20. The closure assembly according to claim 19, wherein the actuator (2) further comprises an actuator ring (2.*b*) on the outer wall that is disposed circularly towards a free space between the outer wall (2.*e*) and the conical portion of the inner element (2.*d*).

21. The closure assembly according to claim 20, wherein the closure assembly further comprises a cover (1) connected to the base body (3).

22. The closure assembly according to claim 21, wherein the cover (1) corresponds to a hood that comprises a cylindrical body closed at a top end thereof and open at a bottom end thereof, wherein the cover comprises:

a safety belt (1.*e*) attached to the open bottom end of the hood;

a cover shoulder (1.*b*) formed around the inner surface of the elongated body on an upper portion thereof;

a tongue-shaped seal element (1.*a*) circularly positioned at a top of the cover, wherein the tongue-shaped seal element extends towards an interior of said cover;

a housing (1.*c*) for fixing the safety belt (1.*e*) to the base body (3); and a bead (1.*d*) for securing the cover (1) to the base body (3).

23. The closure assembly according to claim 22, wherein when the actuator is in the closed position various isolated volumes are defined between the cover (1), the base body (3) and the actuator (2) which act as a barrier to prevent the passage of air or contaminants into the cartridge (4) where the additive is stored, wherein:

a first volume is generated by contact between the shoulder (2.*f*) of the actuator (2) and the cover shoulder (1.*b*);

a second volume is generated by engagement of the actuator ring (2.*b*) with the peripheral nozzle (3.*a*); and a third volume is generated from the central vertical through-hole of the actuator (2), the inner surface of which seals against the tongue (1.*a*) of the cover (1).

24. A process for producing the closure assembly according to claim 1 comprising the steps of:

separately manufacturing the base body (3) and the cartridge (4), wherein the manufacturing of the cartridge (4) comprises:

sealing a lower membrane to the lower end of the removable cartridge;

incorporating a push-cut projectile into the removable cartridge;

injecting the additive into the removable cartridge through an upper end thereof; and sealing an upper membrane to the upper end of the removable cartridge; and wherein the process further comprises:

assembling the removable cartridge to the base body.

* * * * *